United States Patent [19]

Kearney

[11] Patent Number: 4,894,600

[45] Date of Patent: Jan. 16, 1990

[54] ADAPTIVE WORK STATION

[76] Inventor: Deborah A. Kearney, 165 Front St., Chicopee, Mass. 01013

[21] Appl. No.: 261,012

[22] PCT Filed: Apr. 18, 1988

[86] PCT No.: PCT/US88/01205

§ 371 Date: Aug. 24, 1988

§ 102(e) Date: Aug. 24, 1988

[51] Int. Cl.[4] ..... B64C 17/06

[52] U.S. Cl. ..... 318/649; 108/144

[58] Field of Search ..... 108/20, 144, 147, 32; 312/223, 239, 312; 318/264–266, 625, 626, 649, 560–561, 563, 649

[56] References Cited

U.S. PATENT DOCUMENTS

| | | | |
|---|---|---|---|
| 1,293,952 | 10/1918 | Shirley | 312/208 |
| 2,614,018 | 10/1952 | Engel | 312/239 |
| 3,048,461 | 8/1962 | Peterson | 312/239 |
| 3,087,767 | 4/1963 | Schell | 312/239 |
| 3,696,760 | 10/1972 | Riley | 108/32 |
| 3,938,766 | 12/1974 | Herbolsheimer et al. | 312/208 |
| 4,315,466 | 2/1982 | Boerigter | 108/144 |
| 4,345,803 | 8/1982 | Heck | 312/239 |
| 4,365,561 | 12/1982 | Tellier et al. | 108/32 |
| 4,576,424 | 3/1986 | Nelson | 312/231 |
| 4,705,327 | 11/1987 | Bollman | 108/8 |

*Primary Examiner*—William M. Shoop, Jr.
*Assistant Examiner*—David Martin
*Attorney, Agent, or Firm*—Albert O. Cota

[57] ABSTRACT

A work station which has a work table top (30) in truncated "U" shape with end panels (32) and a rear panel (34) each having height adjusting angular legs (38) and (40). A pair of side skirts (36) are abutted against the panels enclosing one side of the work station. The height is adjusted by linear actuators (44) attached between the legs and panels controlled electrically, allowing a physically challenged or developmentally disabled person to utilize the work station while sitting in a wheelchair with the ability to adjust the height to an optimum level. Other embodiments provide manual adjustment of the height and platform enclosures (88), (98) and (102) mounted on top of the work station allowing material placed thereupon to be at a convenient angular position relative to the work table top (30).

15 Claims, 4 Drawing Sheets

102
98
100
100
104
92
90
94
88
96
94
92
34
38
90
96
30
32
90b
32

102
102
92a
92a
96
94

102
104
90b
94
94
94
89

94
94

100
90a
94a
94a
98
90a
100

100
90a
94a
94a
98
89

100
98
100
94a
100

92
90
88
96
94
96
91
90
94

88
90
94
94
89
90
91

88
92
92
94
94
91

ADAPTIVE WORK STATION

TECHNICAL FIELD

The present invention pertains to the general field of work stations, and more particularly to adjustable and portable work stations that are variable in height and tilt to facilitate wheelchair confined physically challenged and developmentally disabled workers.

BACKGROUND ART

Previously, many types of desks, tables, and cabinets have been developed or specific purposes. Many devices contain height adjusting or angle adjusting features for specific purposes, such as drawing boards or platforms for office equipment.

A search of the prior art did not disclose any patents that read directly on the claims of the instant invention, however, the following U.S. Patents were considered related:

| U.S. Pat. No. | Inventor | Issue Date |
|---|---|---|
| 4,576,424 | Nelson | Mar. 18, 1986 |
| 4,345,803 | Heck | Aug. 24, 1982 |
| 3,938,766 | Herbolsheimer et al | Feb. 17, 1976 |
| 3,696,760 | Riley | Oct. 10, 1972 |
| 3,087,767 | Schell | Apr. 30, 1963 |
| 3,048,461 | Peterson | Aug. 7, 1962 |
| 2,614,018 | Engel | Oct. 14, 1952 |

Nelson teaches a cabinet with drawers and a top that may be lifted and rotated outwardly to form a drawing board which is angularly adjustable and includes knee room to sit in front thereof.

Heck discloses a work station angular desk for an office machine that has a recess in the center surface extending to the front edge providing a lower level recess area for an office machine. The desk is free standing and has a pair of opposed deenergizing side sections. However, no height adjustment is disclosed.

Herbolsheimer et al utilize an adjustable platform mechanism including a U-shaped base plate which is horizontally mounted at a spaced distance below the desk top. Four jack screws are positioned between the desk top and the platform and means are provided to simultaneously rotate all of the jack screws using a manual handle.

Riley teaches a modular classroom table that has a plurality of inclined desk surfaces along one edge of a horizontal top. These desk surfaces are independently raised or lowered to fit the individual student. The opposite edge is provided with a plurality of cut-outs which, when combined with other like tables define geometrical figures, such as circles or semi-circles. Height adjustment of the desk surface is accomplished using threaded fasteners through slots with wing nuts creating a structural connection.

Peterson practices an automatic desk for the disabled, particularly the wheelchair confined. The desk is provided with remotely controlled desk trays which are electrically movable from a remote, out of the way position on the desk top to an accessible location. Further, the desk is furnished with electrically actuated means for extending a telephone from the desk top to the user with a combination of drive pulleys and belts using an electrical reversible motor. A recess is included in the front edge of the desk to permit entry of a lap board and wheelchair control box. A central control panel is available to the worker to control the trays, phone, etc., remotely.

For background purposes and as indicative of the art to which the invention relates, reference may be made to Schell and Engel.

DISCLOSURE OF THE INVENTION

Prior art has attempted to assist wheelchair confined, physically-challenged workers by placing certain specific articles within their reach. Also multiple-use desks and cabinets have been developed to expand the utility of working areas. The need continues to exist for a work station that fits any wheelchair in height and allows the worker an expanded three sided surface from the center of the work area. The instant invention does just that. Therefore, a primary object of the invention is the ability to easily adjust the height and tilt of the apparatus by electrical means readily available to the worker with a configuration that allows access to the top, on not only the center, but also on both sides. A second embodiment allows adjustment for a particular wheelchair height where only one worker is involved and repeated height adjustment is unnecessary. However, the same accessibility is available to the top surface.

An important object of the invention is a safety mechanism that stops downward travel and reverses the work station if an obstruction is encountered. This protects the operators safety when their handicap does not allow visual indication of an obstruction between the work station and wheelchair.

Another object of the invention is the ease of assembly of the work station. All parts are unitized and preconnected requiring a minimum of time and effort for set-up.

Still another object of the invention utilizes a combination of adjustable swivel based platforms that may be employed singly or in concert. Each platform has angularly adjustable shelves allowing articles such as papers, publications, etc., to be positioned where the worker has visual contact and physical access.

Yet another object of the invention in a second embodiment provides a work station that is easily assembled and broken down to accommodate job changes, movement to training sites, and use in the home. The weight of each section is limited to 20 pounds. Hinges attach parts together to assist in assembly.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
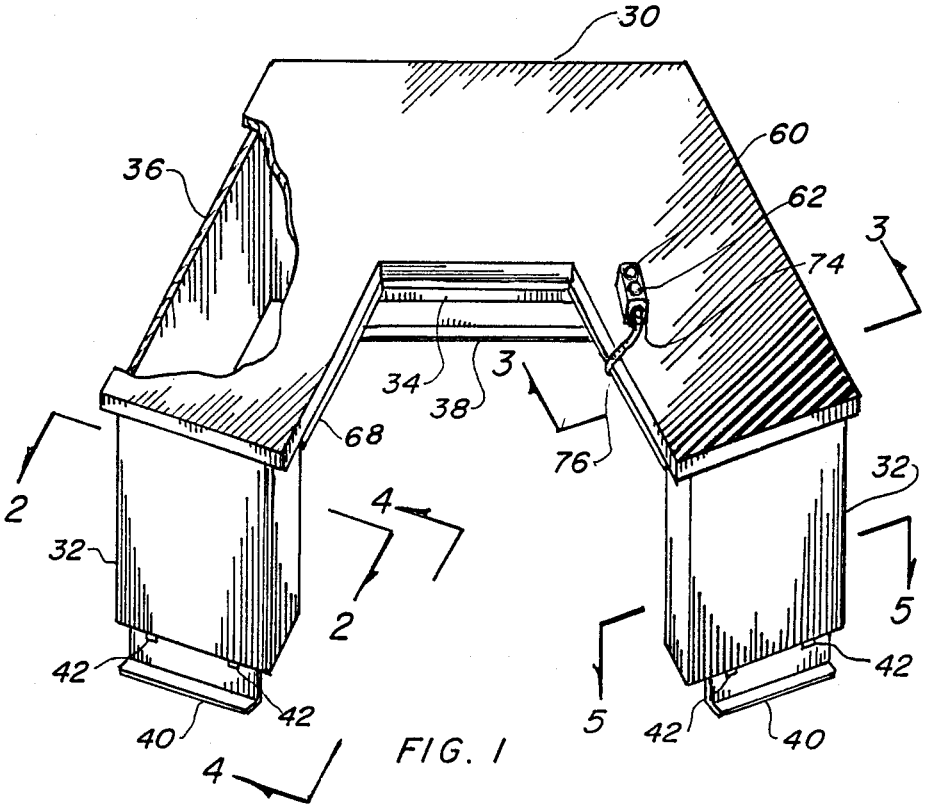
FIG. 1 is a partial isometric view of the preferred embodiment.
Figure 2:
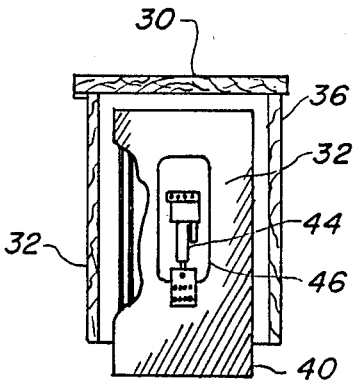
FIG. 2 is a cross-sectional view taken along lines 2—2 of FIG. 1 illustrating a linear actuator and its relationship between the leg and the end vertical panel.
Figure 3:
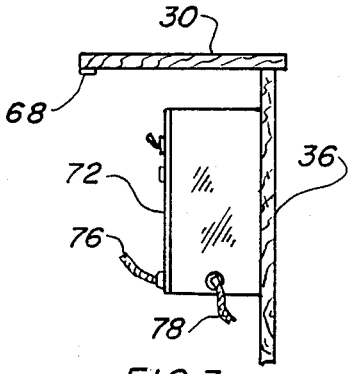
FIG. 3 is a cross-sectional view taken along lines 3—3 of FIG. 1 illustrating the enclosure housing the majority of the electrical controls.
Figure 4:
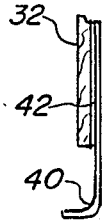
FIG. 4 is a cross-sectional view taken along lines 4—4 of FIG. 1 showing the relationship of the leg and the panel sliding along with the ball bearing track.
Figure 5:
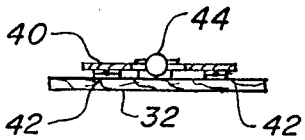
FIG. 5 is a cross-sectional view taken along lines 5—5 of FIG. 1 depicting the linear actuator and tracks.

The best mode for carrying out the invention is presented in terms of a preferred, second and third embodiment. All three embodiments are primarily designed using the same basic work station, except the second embodiment utilizes manual adjustment for the work station height and the third adds a set of adjustable enclosures on top for placing articles at a convenient angle.

The preferred embodiment, as shown in FIGS. 1 through 7 is comprised of a work table top 30 in a truncated "U" shape. The top 30 has a center angular sides as well as ends. The top is preferably made of a plywood material with a plastic work surface known by its registered trademark 'FORMICA', or any similar material. The top 30 is sufficiently thick to support objects placed thereupon and is hard and smooth enough to write upon. A pair of end panels 32 are attached to the top 30 and serve to support and position the top at a convenient level from the floor. A rear vertical panel 34 is also attached to the top 30 with the same utility. A pair of side skirts 36 extend from the top 30 in like manner and also abut to the end panels 32 and rear panel 34. However, these skirts do not necessarily touch the floor. The material of all of the vertical members may be of the same material as the top or may be a plywood laminate having a variety of coatings or film in plastic or the like simulating a wood pattern. A solid color is also acceptable.

The height of the work station is variable from 26 inches (66 cm) to 42 inches (107 cm) from the floor to the table top 30 in order to compensate for various power and/or manual wheelchairs. The adjustment of the height in the preferred embodiment is accomplished by means readily available to individual physically challenged personnel using the work station. This adjustment allows an optimum height to be easily obtained allowing a full fit under the top 30 and a greater range of motion for the worker to minimize stress and fatigue.

The height-adjusting means consist of a plurality of angular legs, preferably with a single center leg 38 and a pair of end legs 40 forming a triangular structure capable of bearing the entire weight of the work station. The legs 38 and 40 are attached to the corresponding rear panel 34 and end panels 32 with a pair of ball bearing tracks 42. The tracks 42 are spaced apart near each vertical edge of the legs to give them a greater bearing surface, also they are exactly parallel with each other allowing the legs 38 and 40 to move easily up or down within the limitations of the tracks.

Each leg has an electromechanical linear actuator 44 interfaced between the leg and the panel. The legs have a rectangular opening 46 through which the actuator 44 is mounted allowing both elements to be connected in between. The actuator 44 is a sealed D.C. motor type with an acme screw drive and internal limit switches that shut down the travel at each end of a stroke. The preferred actuator 44, best illustrated in FIG. 2, has a 75 pound (34 kg) force at an extension speed of 0.6 inches/-second (1.5 cm/second) and a stroke of 6.0 inches (15.2 cm). While this preferred embodiment is ideal for the application, any other suitable actuator may also be used. Therefore, the invention is not limited to this particular device.

The actuator 44 is controlled by means having remote switches that are electrically connected to provide electrical direct current in either polarity. This feature allows simultaneous operation of the remote switches for height control or individual energization from a fixed station for leveling.

Figure 7:
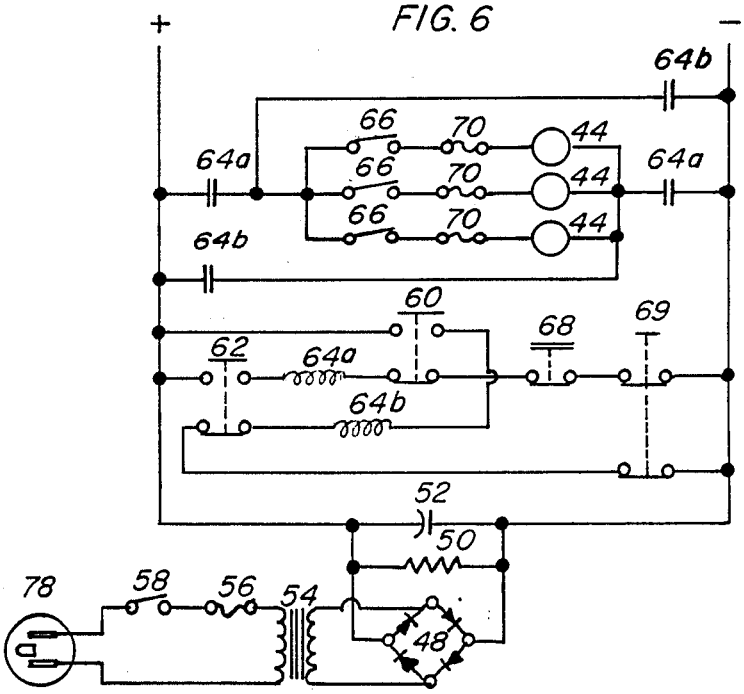
FIG. 7 is an electrical schematic of the controls and actuators for adjusting the height of the work station.
Figure 8:
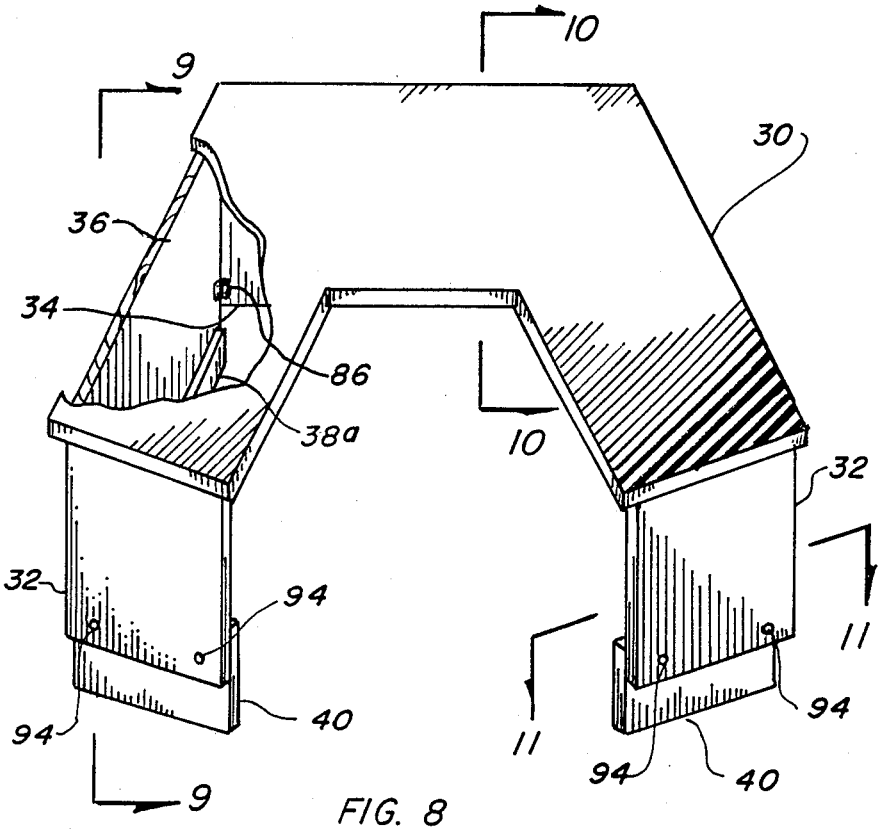
FIG. 8 is a partial isometric view of the work station wherein the leg adjustment is provided by fasteners with wing nuts.
Figure 9:
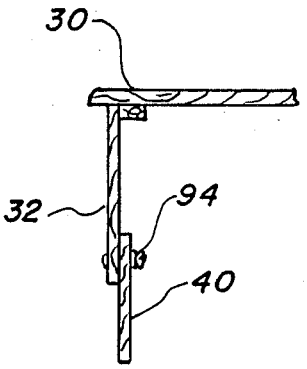
FIG. 9 is a cross-sectional view taken along lines 9—9 of FIG. 8 illustrating the leg and end panel.
Figure 10:
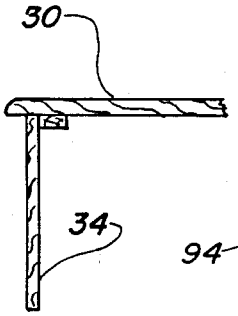
FIG. 10 is a cross-sectional view taken along lines 10—10 of FIG. 8 illustrating the top and front panel.
Figure 11:
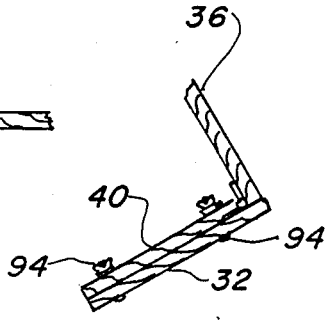
FIG. 11 is a cross-sectional view taken along lines 11—11 of FIG. 8 illustrating the corner panel.

The controls are depicted schematically in FIG. 7 and include an alternating current to direct current converter in the form of a rectifier bridge 48, also a bleeder resistor 50 and a voltage-smoothing capacitor 52. This portion of the system also includes a step-down transformer 54, an, input power fuse 56 or circuit breaker and a power switch 58. The converter reduces the city voltage of 120 volts a–c to the 24 volts d–c required by the actuators 44.

Polarity-reversing means for directional control of the actuators 44 include an up-switch 60 and a down-switch 62, each being a double-pole single-throw momentary-on push button type. Each switch 60 and 62 is connected to a relay 64*a* and 64*b*, each having a pair of normally open contacts. When these relays are energized by the push button switches 60 or 62, the circuit to the actuators is closed. When this circuit closes, a negative current flow is provided for the up direction and a negative to positive current is provided for lowering the positioning of the table top 30 by reversing the polarity of the direct current power to the actuators 44.

Three individual position switches 66 are located in the circuit to the corresponding actuators 44 for controlling specific actuators to level or tilt the work station. This procedure is accomplished by manually opening the switches 66 not to be actuated and pushing the up or down switch 60 or 62 to move the remaining actuators 64 in the desired direction.

Touch-sensitive limit protection to stop the downward travel of the work station top 30 (if the wheelchair is in the way) is achieved by a safety strip switch 68. This switch 68 is located in the circuit from the push button switch 62 and relay 64 and disallows continuation of the travel when energized. Physically, this switch is located under the work table top 30 at the position of the wheelchair arms.

Short circuit protection is afforded by the use of the aforementioned input power fuse 56 or circuit breaker. Similar actuator fuses 70 are in each circuit in line with the individual actuators 44 protecting them as well as the entire system from ground shorts or phase-to-neutral short circuits.

Figure 6:
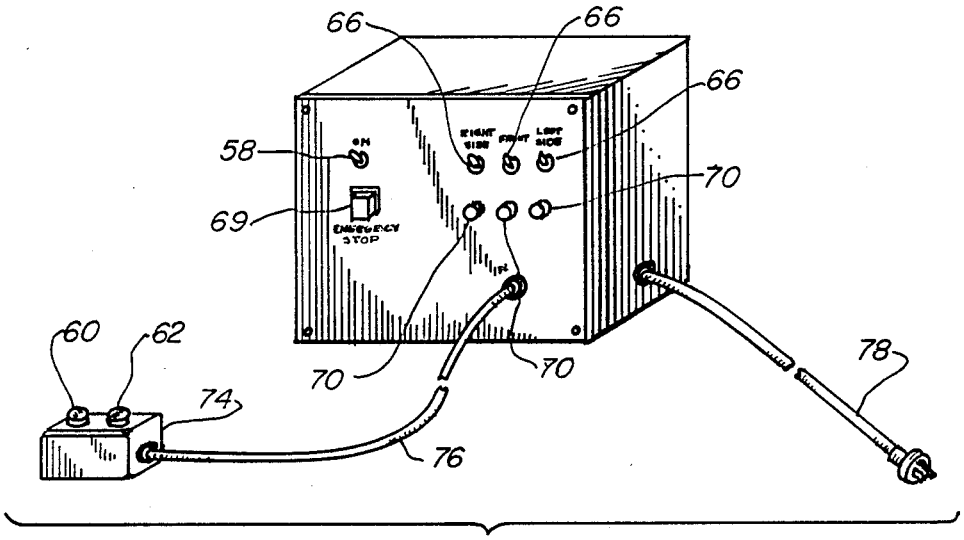
FIG. 6 is a partial isometric view of the enclosure housing, the electrical controls, and the remote height adjusting switches completely removed from the invention for clarity.

The controls are housed in a control box 72, best illustrated in FIG. 6, and the up and down switches 60 and 62 have their own remote control station 74 connected to the box 72 with a flexible electrical cord 76. The house power is supplied to the control box 72 with a plug and input cord 78 well known in the art. Wiring between the box 72, actuators 44 and safety strip switch 68, is accomplished by the state of the art procedures in conduit, loom, cable, or individual insulated wires, or the like.

The second embodiment, shown in FIGS. 8 through 11, is much like the preferred embodiment, except it is simpler and less costly to produce. The top 30, end panels 32, panel 34 and side skirts 36 are similar in structure and utility, except the legs 38*a* and 40*a* are flat, not angled, and are attached to the end panels 32 and side skirts 36 with threaded fasteners applied through slots in the legs and holes in the end panels and skirts. The threaded fasteners may be of any type. However, round headed screws with wing nuts are preferred. Adjustment of this embodiment is made by manually loosening the fasteners and sliding the legs 38*a* and 40*a* to the desired height and tightening the wing nuts. This second embodiment optionally contains hinges 86 between the vertical elements to allow ease of assembly and dissembly. It is evident that this embodiment is basic, lightweight, easy to assemble, cost effective, and yet, fills the need for a relatively permanent work station that may be set up once and used by the same person and where the disability is such that readily available adjustment is of little importance.

The third embodiment incorporates the work station of either the preferred embodiment or the second embodiment and consists of a plurality of platform enclosures, each having angularly alterable shelves configured to rest upon the top of the work station such that the disabled person will have a convenient surface on which to place work related material.

This third embodiment is illustrated in FIGS. 12 through 21 and includes a set of three enclosures which individually sit stationary or swivel on the top of the work station side by side. They may also hang on the wall or be mounted on a mobil base. Each enclosure has a bottom drawer for small item storage.

Figures 12, 13, 14, 15, 16, 17, 18, 19, 20, 21:
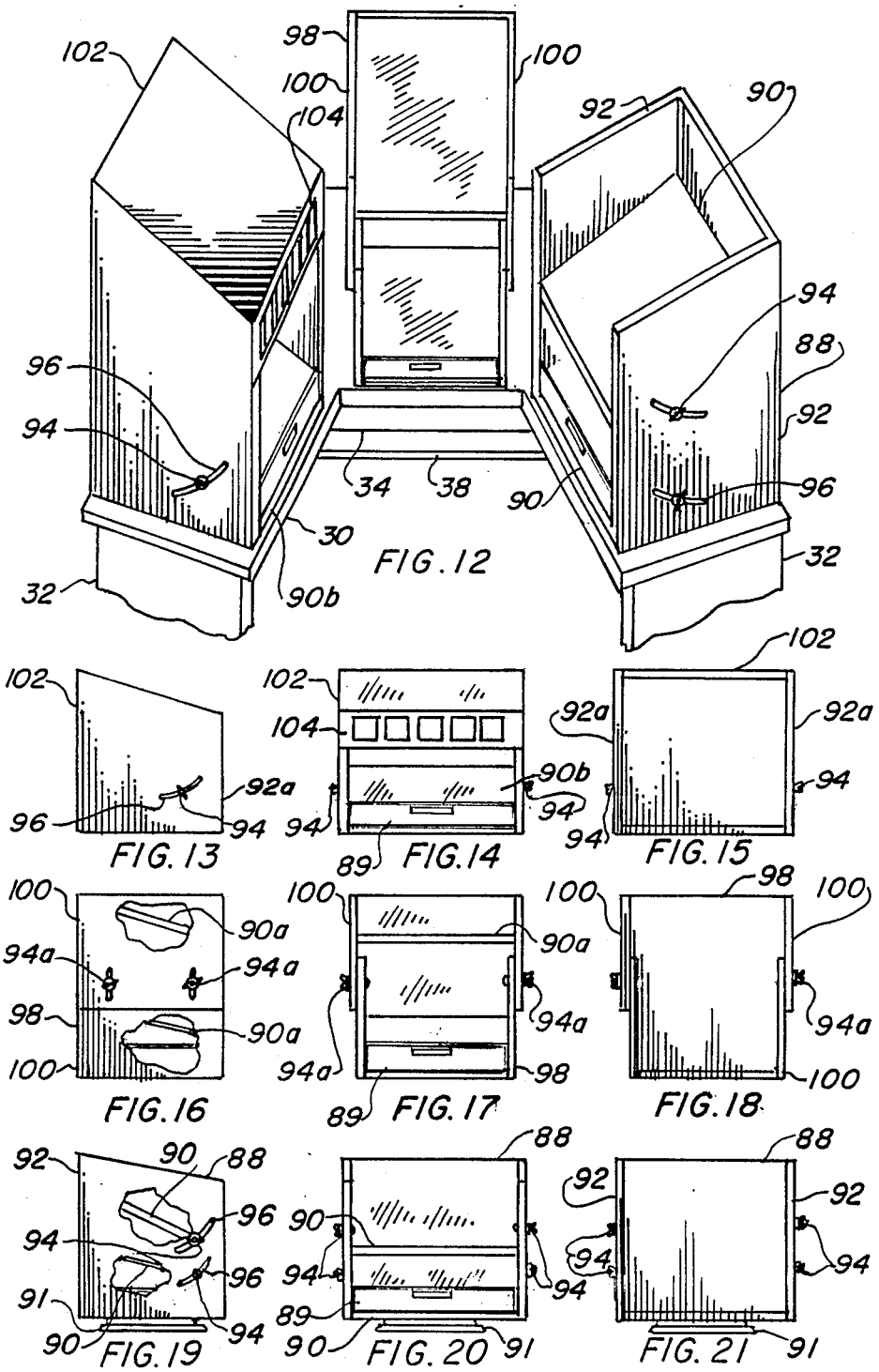
FIG. 12 is a cut-away partial isometric view of the adjustable shelf enclosures mounted on top of the work station.
FIG. 13 is a side elevational view of the side adjustable platform, with an electrical panel.
FIG. 14 is a front elevational view of the side adjustable platform with an electrical panel.
FIG. 15 is a rear elevational view of the side adjustable platform with an electrical panel.
FIG. 16 is a side elevational view of the center adjustable platform.
FIG. 17 is a front elevational view of the center adjustable platform.
FIG. 18 is a rear elevational view of the center adjustable platform.
FIG. 19 is a side elevational view of the side adjustable platform.
FIG. 20 is a front elevational view of the side adjustable platform.
FIG. 21 is a rear elevational view of the side adjustable platform.

The first enclosure is a side adjustable platform 88, shown in FIGS. 19 through 21, that has a pair of shelves 90 one on top of the other and a pair of vertical sides 92, each having a pivotal interface with a stud, or the like, and adjustment means 94 in the form of a threaded stud or flattened threaded rod fastened to each end of the shelf. The threaded fastener extends through a radial slot 96 in the side 92 and a wing nut holds the adjustment means 94 in place. Each shelf is then adjustable within the limits of the slot 96 and provides an optimum angular surface on which to store items and provide visual access for the disabled worker. The enclosures may have a swivel base 91 as an option as shown in FIGS. 19–21. The platform 88 may be of any material suitable for the purpose, such as metal, wood, composition board, or the like.

The second enclosure is a outer adjustable platform 98, shown in FIGS. 16 through 18, with shelves 90*a* and sides 100, not unlike the above, except the sides 100 are split into two pieces and are slideably connected with adjusting means 94*a* the same as previously described.

The third enclosure is a side adjustable platform with an electrical panel 102, shown in FIGS. 13 through 15. The sides 92*a* and shelf 90*b* are the same as the first enclosure, except an electrical panel 104 is included that is located above the shelf 90*b*. This panel 104 contains electrical apparatus for adaptive aids, including a clock, timer, etc., to alert the worker of the time of the task and necessary breaks.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the claims.

I claim:

1. A work station adapted for facilitating physically challenged and developmentally disabled personnel comprising:

(a) a work table top in a truncated "U" shape having a center, angular sides, and ends on the outside periphery, formed of a flat, relatively hard material suitable for working thereupon, further having the structural integrity to support objects placed thereupon, (b) a pair of end vertical panels extending downward from the ends of the table top to support the top at a convenient height from a floor, (c) a vertical panel extending downward from the rear of the table top furnishing structure to support the table top and form an enclosing surface, (d) a pair of side skirts extending downward from the angular sides of the table top contiguously abutting the end vertical panels and the rear vertical panel forming a protective vertical enclosure and weight bearing member, and (e) height-adjusting means allowing the distance from a floor to the top of the table top to be altered such that different size wheelchairs may be accommodated under the table top.

2. The work station as recited in claim 1 wherein said height adjusting means further comprises a plurality of flat legs having slots therein juxtapositioned with said end vertical panels and said side skirts, with said end vertical panels and side skirts having holes therein in alignment with said slots, such that continuity is defined over a range of height adjustment, and a threaded fastener and thumb screw attached together with the fastener simultaneously penetrating each hole and slot characterizing a slideable adjustment of the height of the work station by manipulation of the thumb screws and manually sliding the legs to the desired height.

3. The work station as recited in claim 1 wherein said height adjusting means define a height of from 26 inches (66 cm) to 42 inches (107 cm) from a floor upon which the work station is resting to the work table top.

4. A work station adapted for facilitating physically challenged and developmentally disabled personnel comprising:

(a) a work table top in a truncated "U" shape having a center, angular sides, and ends on the outside periphery, formed of a flat, relatively hard material suitable for working thereupon, further having the structural integrity to support objects placed thereupon, (b) a pair of end vertical panels extending downward from the ends of the table top to support the top at a convenient height from a floor, (c) a vertical panel extending downward from the rear of the table top furnishing structure to support the table top and form an enclosing surface, (d) a pair of side skirts extending downward from the angular sides of the table top contiguously abutting the end vertical panels and the rear vertical panels forming a protective vertical enclosure and weight bearing member, and (e) height-adjusting means having a plurality of angular legs with at least a rear leg and a pair of end legs forming a triangular structure capable of bearing the weight of the work station;

(f) a plurality of ball bearing tracks, at least two slidingly attached to said rear leg on one side and to said rear vertical panel on the other, also at least two tracks slidingly attached to each end leg on one side and to said end vertical panels on the other defining a sliding structural interface between the legs and the panels allowing the work station to move in a vertical direction within the limitations of the tracks;

(g) a plurality of electrochemical linear actuators attached to said legs on one side and to said rear and end panels on the other providing the electromotive force to move the work station in a vertical direction up or down to accommodate the disabled personnel using the work station; and, (h) electrical control means having remote switches in communication with said linear actuators providing regulated electrical power allowing simultaneous energization of said actuators from the remote switch, as well as individual energization of the actuators from a fixed station for leveling providing the disabled work personnel controlled adjustment of the height of the work station to an optimum level.

5. A work station adapted for facilitating physically challenged and developmentally disabled personnel comprising:

(a) a work table top in a truncated "U" shape having a center, angular sides, and ends on the outside periphery, formed of a flat, relatively hard material suitable for working thereupon, further having the structural integrity to support objects placed thereupon, (b) a pair of end vertical panels extending downward from the ends of the table top to support the top at a convenient height from a floor, (c) a vertical panel extending downward from the rear of the table top furnishing structure to support the table top and form an enclosing surface, (d) a pair of side skirts extending downward from the angular sides of the table top contiguously abutting the end vertical panels and the rear vertical panel forming a protective vertical enclosure and weight bearing member, and, (e) height-adjusting means having a plurality of angular legs with at least a rear leg and a pair of end legs forming a triangular structure capable of bearing the weight of the work station;

(f) a plurality of ball bearing tracks, at least two slidingly attached to said rear leg on one side and to said rear vertical panel on the other, also at least two tracks slidingly attached to each end leg on one side and to said end vertical panels on the other defining a sliding structural interface between the legs and the panels allowing the work station to move in a vertical direction within the limitations of the tracks; a plurality of electromechanical linear actuators attached to said legs on one side and to said rear and end panels on the other providing the electromotive force to move the work station in a vertical direction up or down to accommodate the disabled personnel using the work station, and, (g) electrical control means having remote switches in communication with said linear actuators providing regulated electrical power allowing simultaneous energization of said actuators from the remote switch, as well as individual energization of the actuators from a fixed station for leveling providing the disabled work personnel controlled adjustment of the height of the work station to an optimum level, also alternating current to direct current converter means changing incoming alternating current to direct current for directional operation of said linear actuators;

(h) polarity reversing means for controlling the direction of rotation of said linear actuators when energized by the direct current supplied by the converting means, (i) three individual position switches for controlling specific linear actuators direction of rotation for leveling the work station;

(j) touch sensitive limit protection to impede the downward travel of said work station top if objects such as a wheelchair obstruct the downward movement of the work station table top; and, (k) short circuit protection means.

6. A work station adapted for facilitating physically challenged and developmentally-disabled personnel comprising:

(a) a work table top in a truncated "U" shape having a center, angular sides and ends on the outside periphery, formed of a flat, relatively hard material suitable for working thereupon, further having the structural integrity to hold objects thereupon;

(b) a pair of end vertical panels extending downward from the ends of the table top to support the top at a conventional height from a floor;

(c) a vertical panel extending downward from the rear of the table top furnishing structure to support the table top and form an enclosing surface;

(d) a pair of side skirts extending downward from the angular sides of the table top contiguously abutting the end vertical panels and the rear vertical panel forming a protective vertical enclosure and weight-bearing member;

(e) height-adjusting means allowing the distance from a floor to the top of the table top to be altered such that different size wheelchairs may be accommodated under the table top and, (f) a plurality of platform enclosures each having a plurality of angularly alterable shelves, configured to rest upon the table top such that the disabled person using the work station will have material that has been placed on the shelves at a convenient angular position relative to the work table top.

7. The work station as recited in claim 6 wherein said height adjusting means further comprise; a plurality of flat legs having slots therein juxtapositioned with said end vertical panels and said side skirts, with said vertical panels and side skirts having holes therein in alignment with said slots such that continuity is defined over a range of height adjustment, and a threaded fastener and thumb screw attached together with the fastener simultaneously penetrating each hole and slot characterizing a slideable adjustment of the height of the work station by manipulation of the thumb screws and manually sliding the legs to the desired height.

8. The work station as recited in claim 6 wherein said height adjusting means defines a height of from 26 inches (66 cm) to 62 inches (107 cm) from a floor upon which the work station is resting to the work table top.

9. The work station as recited in claim 6 wherein said platform enclosures further comprise; a set of three enclosures of a size no greater than said work table top when placed side by side thereupon, said set including a side adjustable platform, a center adjustable platform, and a side adjustable platform with an electrical panel.

10. The work station as recited in claim 9 wherein said side adjustable platform further comprises; a drawer, a pair of shelves, one on top of the other, a pair of vertical sides each having a pivotal interface with said shelves and means to manually adjust the angle of the shelf to provide an angular surface to store and have visual access of items resting thereupon.

11. The work station as recited in claim 9 wherein said center adjustable platform further comprises; a pair of shelves, one on top of the other, a drawer, a pair of split vertical sides slideably-connected in an extending and contracting manner, each having a pivotal interface with said shelves and means to manually adjust the angle of the shelf to provide an angular surface to store and have visual access of items resting thereon.

12. The work station as recited in claim 9 wherein said side adjustable platform with an electrical panel further comprises; a shelf having pivotal connection means, a pair of sides attached to the pivotal connection means of said shelf, and an electrical panel joined between said sides above said shelf having electrical apparatus for adaptive aids and time indication.

13. The work station as recited in claim 6 further comprising a swivel base disposed under said platform enclosures allowing pivotal rotation therewith.

14. A work station adapted for facilitating physically challenged and developmentally-disabled personnel comprising:

(a) a work table top in a truncated "U" shape having a center, angular sides and ends on the outside periphery, formed of a flat, relatively hard material suitable for working thereupon, further having the structural integrity to hold objects thereupon;

(b) a pair of end vertical panels extending downward from the ends of the table top to support the top at a convenient height from a floor;

(c) a vertical panel extending downward from the rear of the table top furnishing structure to support the table top and form an enclosing surface;

(d) a pair of side skirts extending downward from the angular sides of the table top contiguously abutting the end vertical panels and the rear vertical panel forming a protective vertical enclosure and weight-bearing member;

(e) height-adjusting means allowing the distance from a floor to the top of the table top to be altered such that different size wheelchairs may be accommodated under the table top having, (f) a plurality of angular legs with at least a rear leg and pair of end legs forming a triangular structure capable of bearing the weight of the work station;

(g) a plurality of ball bearing tracks, at least two slidingly attached to said rear leg on one side and to said rear vertical panel on the other, also at least two tracks slidingly attached to each end leg on one side and to said end vertical panels on the other defining a slideable structural interface between the legs and the panels allowing the work station to move in a vertical direction within the limitations of the tracks;

(h) a plurality of electromechanical linear actuators attached to said legs on one side and to said rear and end panels on the other providing the electromotive force to move the work station in a vertical direction up or down to accommodate the disabled personnel using the work station;

(i) electrical control means having remote switches in communication with said linear actuators providing regulated electrical power allowing simultaneous energization of said actuators from the remote switch, as well as individual energization of the actuators from a fixed station for leveling, providing the disabled work personnel controlled adjustment of the height of the work station to an optimum level; and (j) a plurality of platform enclosures each having a plurality of angularly alterable shelves, configured to rest upon the table top such that the disabled person using the work station will have material that has been placed on the shelves at a convenient angular position relative to the work table top.

15. A work station adapted for facilitating physically challenged and developmentally-disabled personnel comprising:

(a) a work table top in a truncated "U" shape having a center, angular sides and ends on the outside periphery, formed of a flat, relatively hard material suitable for working thereupon, further having the structural integrity to hold objects thereupon;

(b) a pair of end vertical panels extending downward from the ends of the table top to support the top at a convenient height from a floor;

(c) a vertical panel extending downward from the rear of the table top furnishing structure to support the table top and form an enclosing surface;

(d) a pair of side skirts extending downward from the angular sides of the table top contiguously abutting the end vertical panels and the rear vertical panel forming a protective vertical enclosure and weight-bearing member;

(e) height-adjusting means allowing the distance from a floor to the top of the table top to be altered such that different size wheelchairs may be accommodated under the table top having a plurality of angular legs with at least a rear leg and pair of end legs forming a triangular structure capable of bearing the weight of the work station;

(f) a plurality of ball bearing tracks, at least two slidingly attached to said rear leg on one side and to said rear vertical panel on the other, also at least two tracks slidingly attached to each end leg on one side and to said end vertical panels on the other defining a slideable structural interface between the legs and the panels allowing the work station to move in a vertical direction within the limitations of the tracks;

(g) a plurality of electromechanical linear actuators attached to said legs on one side and to said rear and end panels on the other providing the electromotive force to move the work station in a vertical direction up or down to accommodate the disabled personnel using the work station; and, (h) electrical control means having remote switches in communication with said linear actuators providing regulated electrical power allowing simultaneous energization of said actuators from the remote switch, as well as individual energization of the actuators from a fixed station for leveling, providing the disabled work personnel controlled adjustment of the height of the work station to an optimum level, said electrical control means further having alternating current to direct current converter means changing incoming alternating current to direct current for operation of said linear actuators;

(i) polarity reversing means for controlling the direction of rotation of said linear actuators when energized by the direct current supplied by the inverting means;

(j) individual three position switches for controlling specific linear actuators direction of rotation for leveling the work station;

(k) touch sensitive limit protection to impede the downward travel of said work station top if objects such as a wheelchair obstruct the downward movement of the work station table top and, (l) short circuit protection means for protecting both incoming alternating current and the direct current supplied by said converter means and (m) a plurality of platform enclosures each having a plurality of angularly alterable shelves, configured to rest upon the table top such that the disabled person using the work station will have material that has been placed on the shelves at a convenient angular position relative to the work table top.

* * * * *